United States Patent [19]

Riedel

[11] 4,078,825

[45] * Mar. 14, 1978

[54] SKI BRAKE WITH ELEMENTS ADAPTED TO FORM A TREAD BODY ENGAGEABLE BY A SKI BOOT AND WITH INWARDLY BENT SPRING WIRE

[75] Inventor: Tilo Riedel, Eching, Germany

[73] Assignee: S.A. Etablissements Francois Salomon & Fils, Annecy, France

[ * ] Notice: The portion of the term of this patent subsequent to Jun. 22, 1976, has been disclaimed.

[21] Appl. No.: 665,789

[22] Filed: Mar. 10, 1976

Related U.S. Application Data

[63] Continuation-in-part of Ser. No. 557,476, Mar. 12, 1975, Pat. No. 3,989,271.

[30] Foreign Application Priority Data

| | | |
|---|---|---|
| Mar. 15, 1974 | Germany | 2412623 |
| Jul. 26, 1974 | Germany | 2436155 |
| Feb. 20, 1975 | Germany | 2507371 |

[51] Int. Cl.[2] ..... A63C 7/10

[52] U.S. Cl. ..... 280/605

[58] Field of Search ..... 280/605, 604, 633, 636

[56] References Cited

U.S. PATENT DOCUMENTS

| | | | |
|---|---|---|---|
| 3,219,359 | 11/1965 | Schneider | 280/633 |
| 3,884,487 | 5/1975 | Wehrli | 280/605 |
| 3,964,760 | 6/1976 | Riedel | 280/605 |
| 3,989,271 | 11/1976 | Riedel | 280/605 |

*Primary Examiner*—David M. Mitchell
*Attorney, Agent, or Firm*—Karl F. Ross

[57] ABSTRACT

A ski brake for automatically braking the free flight of the ski upon the release of a ski boot therefrom comprises a mounting plate fixed to an upper surface of the ski and a bent-spring wire having a bight lying in one plane and a pair of offset portions angularly bent from the shank of the bight lying in another plane and received in passages in the mounting plate so that the pressing of the bight toward the surface of the ski resiliently deforms the wire and loads the same so that it tends to spring back into an operative position when the ski boot is released from the surface of the ski. A pair of brake elements are mounted upon the bent-spring wire so as to extend into the snow in the operative position of the brake. The brake elements are extended above the surface of the ski in this latter position so that they can be engaged by the ski boot so as to serve as actuators which can be held down by the ski boot and released when the ski boot is removed from the upper ski surface.

12 Claims, 5 Drawing Figures

SKI BRAKE WITH ELEMENTS ADAPTED TO FORM A TREAD BODY ENGAGEABLE BY A SKI BOOT AND WITH INWARDLY BENT SPRING WIRE

CROSS-REFERENCE TO RELATED APPLICATION

This application is a continuation-in-part of my copending application Ser. No. 557,476 filed Mar. 12, 1975 and entitled "AUTOMATIC BRAKE FOR SKI", now U.S. Pat. No. 3,989,271 issued Nov. 2, 1976.

FIELD OF THE INVENTION

The present invention relates to a device for braking the free flight of a ski upon release of a ski boot from the upper surface of the ski, e.g upon falling of the skier. More particularly the invention relates to a ski brake in which a swingable spring wire is biased by intrinsic spring force caused by deformation of the wire to swing into an operative position.

BACKGROUND OF THE INVENTION

As described in the above-identified application, a ski which is released from a ski boot on a slope, e.g. as a result of the fall of a skier, can engage in free flight and travel at high speeds down the slope to pose a danger to other skiers.

For this reason it has been proposed to provide the ski with an automatic brake which is retained in an inoperative position by application of the heel or toe of the ski boot against the ski, thereby holding an actuator against a spring force which tends to bias brake elements into an operative position extending generally transversely to the ski. The actuator may be engaged by the toe or heel of the boot when the latter is properly received in the ski binding.

Such devices are termed hereinafter generically as ski brakes and generally comprise a mounting plate affixed to the upper surface of the ski and carrying an actuator which is biased under a spring force from the inoperative position in which it is held by the ski boot toward an operative position upon release of the ski boot from the ski.

In one such ski brake, which is mounted behind the binding in a bearing or journal arrangement, the pivot axis includes an acute angle with the longitudinal axis of the ski and the spring force is generated by a torsion spring which acts upon a blade-like brake element.

In another conventional construction, leaf springs are secured at their forward ends to the ski and at their rearward ends tend to bend upwardly when they are unloaded, i.e. upon release of the brake by the ski boot. Upon loading by the ski boot, however, these spring elements are urged toward the upper surface of the ski to swing the blades into positions generally parallel to the ski edges as described in Austrian Pat. No. 299,036. Other ski brakes are described in Austrian Pat. Nos. 280,867 and 210,804 although these devices are somewhat more remote in construction from the present invention than even the prior art devices described above and hence require no detailed discussion.

Austrian Pat. No. 405,844 describes a ski brake having a spring which, upon release of an actuator, rotates a shaft extending transversely to the ski about the ski axis to bring the blade into play.

German published application (Offenlegungsschrift) 2,417,279 describes a ski brake which is mounted by a support plate on the upper surface of the ski. In one recess of the support plate a round-cross-section wire is pivotally journaled and is formed as a first pivot shaft. One end of the round-cross-section wire forms a brake spur while another region of the wire is bent into a retaining hoop, the free end of the hoop being formed as a second shaft journaled in a further recess of the support plate.

It is important in this construction that the two journaling recesses in the support plate be exactly parallel, a factor which increases the fabrication cost and causes differences with respect to mounting or operation if not fulfilled. The two journaling recesses impart an elastic prestress to the round-cross-section wire so that the braking spur automatically springs into the operative position when the wire is released by the ski boot.

OBJECTS OF THE INVENTION

It is the principal object of the present invention to extend the principles set forth in the above-identified application and to increase the versatility of the ski brake there described.

Another object of the invention is to provide a ski brake for the above-described purposes which is simple in construction, is relatively inexpensive, is highly reliable, is free from a tendency to ice up and has parts which do not tend to bind or clamp so as to become ineffective during use.

SUMMARY OF THE INVENTION

These objects are attained, in accordance with the present invention, with the aid of a spring wire bent into a bow and having at least one shank with a free end formed with an angularly bent offset portion received in a guide or mounting element on the upper surface of the ski. The angularly offset portion can extend either inwardly or outwardly and projects from the plane of the bight of the bent wire, preferably as one of a pair of such offset portions.

This construction of the ski brake is relatively simple, inexpensive in construction and functions unobjectionably with fewer parts than earlier ski brakes.

A characteristic of the ski brake according to the invention is that, because of the noncoplanarity of the bight and the offset portion, the pressing of the bight against the surface of the ski results in the elastic deformation of the spring wire which stores the force necessary to swing the bent wire into an operative position in which brake elements carried by the bent wire, e.g. upon the shank of the bight or upon the end of the offset portion, are moved into a position transverse to the ski surface so as to project at least below the latter and prevent free flight of the ski.

According to an important feature of the invention, the brake element or blade is extended beyond the junction of the bight with the offset portion so that at least a portion of the brake element projects above the upper surface of the ski and forms a tread formation which can be engaged by the ski boot to press the ski brake into its inoperative position.

More particularly the ski brake of the present invention comprises a mounting plate fixed to an upper surface of the ski and a bent-spring wire whose bight lies in one plane and has a shank with an angularly bent offset portion lying in another plane, the offset portion being pivotally received in the mounting plate whereby, upon displacement of the bight toward the surface of the ski, the spring wire is resiliently loaded by distortion against the mounting plate and springs upon release of the brake by the ski boot into a position wherein the bight is upstanding from the ski. The brake element or elements mounted upon the spring wire lie generally parallel to the longitudinal edge or edges of the ski in an inoperative position corresponding to the retention of the ski brake by the ski boot. The brake element or elements swing into an operative position to brake free flight of the ski upon movement of the bight into its upright position mentioned above.

Advantageously, the mounting plate is adjustably positionable upon the surface of the ski and can comprise at least two superposed plate members, one lying on top of the other. The mounting plate is formed with a bore receiving each of the offset portions of the bent-spring wire and preferably a bore with a greater width than the diameter of the bent-spring wire so that the offset portions have some mobility within the mounting plate.

Advantageously, the bight has a shank which extends along and is secured to the prolongation of the blade or brake element in the regions thereof projecting above the upper surface of the ski in the operative position of the ski brake. The ski brake can be mounted on the plate in the region of the heel of the ski boot for engagement by the rear part thereof.

The passage for guiding each offset portion can be formed by a pair of spaced-apart webs and advantageously the guide passage is inclined to the longitudinal edge of the ski at an angle other than 90°, e.g. an acute angle such that the passage runs outwardly or inwardly with respect to the lateral longitudinal edges of the ski.

Preferably the bent-spring wire has a pair of such shanks each provided with a respective one of the offset portions, the offset portions being inclined inwardly toward one another and having free extremities disposed within the mounting plate. The shanks can, in the upright position of the bight, diverge downwardly while the offset portions are inclined inwardly, the downward divergence of the shanks causing the brake elements secured thereto straddle the longitudinal edges of the ski.

BRIEF DESCRIPTION OF THE DRAWING

The above and other objects, features and advantages of the present invention will become more readily apparent from the following description, reference being made to the accompanying drawing in which.

SPECIFIC DESCRIPTION

The principles of operation of the brake in accordance with the present invention are identical to those described in the above-identified application which can be referred to for all parts not explicitly described herein. To this extent the prior application (Ser.-No.557,476) mentioned above is incorporated by reference herein.

Figure 1:
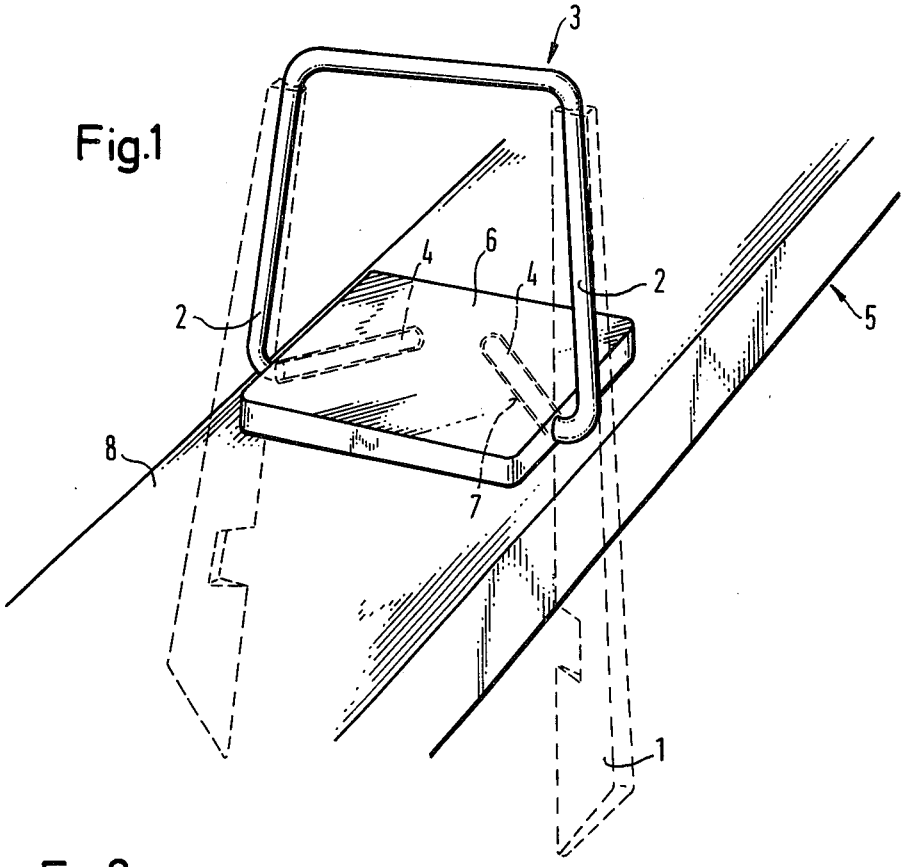
FIG. 1 is a diagrammatic perspective view of a ski brake according to the invention mounted upon a support plate and having ends of the spring wires inclined inwardly toward one another and lying in a plane parallel to the plane of the upper surface of the ski and transverse to the plane of the bight in an erect position of the latter corresponding to an actuated position of the brake.

FIG. 1 shows a brake in accordance with the present invention in which the spring and actuator element is constituted by a bent-wire spring 3 of stirrup shape and generally U configuration. Of course, while the spring 3 of FIG. 1 is shown to be an angularly bent wire with straight shanks 2 and a straight bight portion, other configurations may be employed, for example, a semiarcuate shape, a sinusoidal or undulating shape or the like. At least one shank 2 of the bent-wire spring 3, however, is inwardly bent to form an offset portion 5 and, apart from this, lies in a plane which is other than the plane of the remainder of the shank 2 and consequently the bight of the bent-wire spring.

This, of course, represents the core of the invention since the spring wire stirrup has its shank 2 formed with an angularly bent portion 4 (preferably two such angularly bent portions, one on each of a pair of otherwise coplanar shanks 2) such that the offset or bending of the offset portion 4 is two-fold, namely, once inwardly with respect to the longitudinal edges of the ski and secondly out of the plane of the shank 2 and the bight.

The offset portion 4 is received in a passage 7 formed in a mounting plate 6 secured to the upper surface 8 of the ski 5. Of course, instead of a mounting plate it is possible to provide another type of guide passage structure. For example, the passage may be formed directly in the surface of the ski in whole or in part.

The guide passage, in any event, must be capable of applying a bending stress to the bent-spring-wire when the latter is swung downwardly from the position shown in FIG. 1.

Brake elements 1 are provided upon the shanks 2 of the bent-spring wire and are fastened thereto. For example, recesses can be formed in the brake elements or blades 1 which receive the shanks 2 of the bent-spring wire.

While the structure of the invention has been illustrated with two such blade elements or blades 1, it will be apparent that the bent-spring wire need be provided with only one such brake element without being rendered ineffective and further that the bent-spring wire need only have a single shank as long as this shank has an offset portion which is inclined inwardly with respect to the longitudinal edges and axis of the ski and is also bent out of the plane of the shank.

Figure 2:
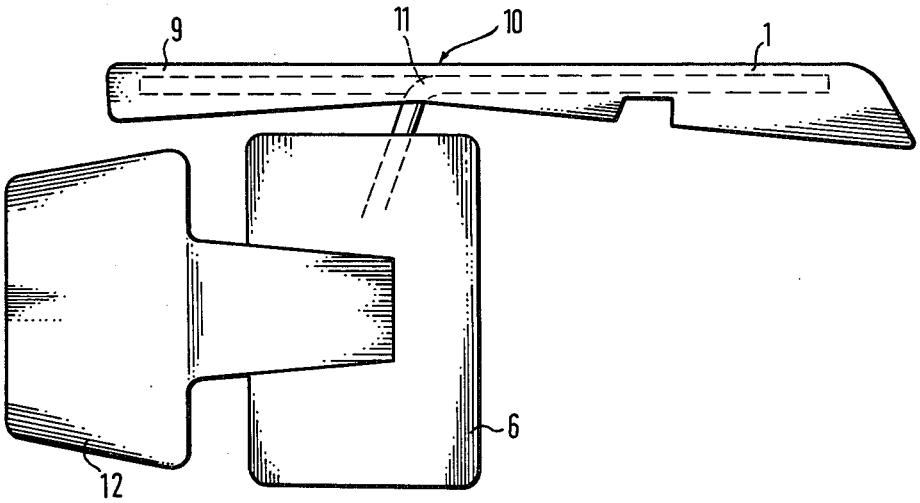
FIG. 2 is a plan view of an embodiment of a brake blade or element which has a prolongation which can be engaged by the ski boot.

FIG. 2 shows an embodiment of the invention in which the brake element 1 is fixed to an offset portion extending from a mounting plate at a region 10 intermediate along the length of the brake element or blade. The latter can be provided with a welded location 11 at which the blade element is affixed to the spring wire. A prolongation 9 of the blade element 1, however, extends rearwardly from the snow-engaging portion of the blade and, in the operative position of the brake, lies above the upper surface of the ski so that it forms a tread surface which can be engaged by the ski boot when the latter is applied to the surface of the ski. When the tread surface 9 is formed on the brake element 1 itself, the bent-spring wire can have its bight relatively short so that it need not provide the boot-engaging surface but can simply serve to provide the necessary restoring force tending to swing the brake elements into their operative positions. The shortened bight may also be engaged by a tread plate 12 which can bear upon the bight if necessary. Of course the tread plate 12, which can be swingably mounted upon the support plate 6, can be eliminated if desired when the prolongations 9 are positioned for engagement by the ski boot.

Figure 3:
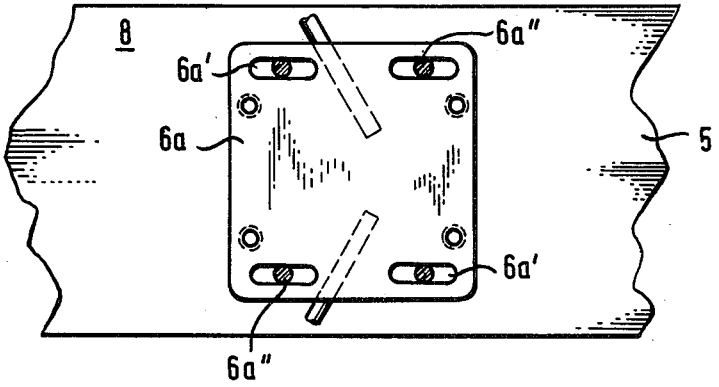
FIG. 3 is a diagrammatic plan view showing the mounting of the lower member of a bipartite mounting plate adjustably upon the surface of the ski.
Figure 4:
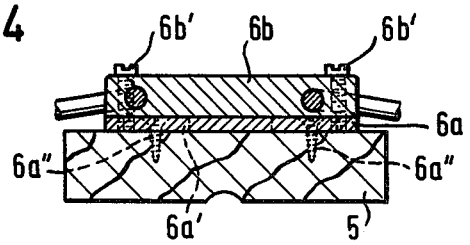
FIG. 4 is a cross section through the composite mounting plate.

As can be seen in FIGS. 3 and 4, the support plate 6 can be mounted upon the upper surface of the ski 5 by forming it as a bipartite structure with a lower plate member 6*a* and an upper plate member 6*b*. The lower plate member 6*a* can be formed with slots 6*a*′ through which screws 6*a*″ can pass to allow adjustment of the position of the plate member 6*a* along the screw. Once the plate is positioned at the proper location, the screws 6*a*′ are tightened. The upper plate member 6*b* can be attached to the lower plate member 6*a* by screws 6*b*′.

Figure 5:
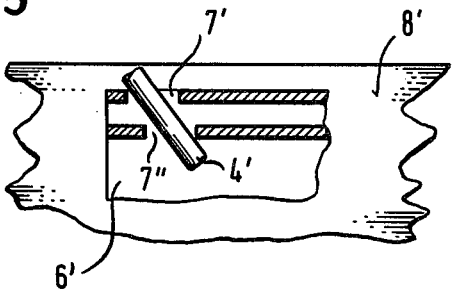
FIG. 5 is a horizontal section through the mounting plate showing the use of webs or ribs to define the guide passage for the bent-spring wire.

FIG. 5 shows an embodiment of the invention in which the plate 6′ fixed to the upper surface 8′ of the ski is formed with ribs or webs 7′ which define the passage 7″ guiding the offset portion 4′ of the spring wire.

Other structural details of the ski brake of the present invention will be apparent from the above-identified copending application.

I claim:

1. A ski brake for automatically braking the free flight of a ski upon the release of a ski boot therefrom, comprising:

a mounting plate fixed to an upper surface of the ski;

a bent-spring wire having a bight lying in one plane and a shank having an angularly bent offset portion lying in another plane within said plate, said mounting plate being provided with means engaging said offset portion and cooperating therewith so that, upon displacement of said bight toward said surface of said ski, said spring wire is resiliently loaded by distortion against said plate and springs upon release of said brake by said ski boot into an upright position wherein said bight is upstanding from said ski; and at least one brake element mounted upon said spring wire for movement therewith and lying generally parallel to a longitudinal edge of said ski in an inoperative position corresponding to the retention of said ski brake by said ski boot, said brake element swinging into an operative position in which said element extends downwardly from the ski surface beneath said ski to engage the snow to brake free flight of said ski upon movement of said bight into its upright position.

2. The ski brake defined in claim 1 wherein said mounting plate is provided with means for adjustably positioning it upon said surface of said ski.

3. The ski brake defined in claim 1 wherein said mounting plate comprises at least two plate members lying one atop the other.

4. The ski brake defined in claim 1 wherein said engaging means comprises a bore in said mounting plate receiving said offset portion of said bent-spring wire.

5. The ski brake defined in claim 1 wherein said brake element is a blade having a portion reaching downwardly to project below the underside of said ski in said operative position, said blade being secured to said offset portion of said bent-spring wire at a junction, said brake element having a portion colinear with said blade but extending from said junction away from said blade to form a tread surface displaceable by the ski boot to swing said ski boot into its inoperative position.

6. The ski brake defined in claim 5 wherein said bight has a shank extending along and secured to said prolongation.

7. The ski brake defined in claim 1 which is mounted on said upper surface in the region of the heel of said ski boot.

8. The ski brake defined in claim 1 wherein said offset portion defines an acute angle with the longitudinal axis of the ski and said engaging means comprises a guide passage in said mounting plate which is wider than the thickness of said offset portion to permit said spring wire to shift forwardly and rearwardly in said passage.

9. The ski brake defined in claim 1 wherein said engaging means includes a pair of webs along each opposite side of said plate, each of said webs in each pair being formed with a respective hole defining a passage for engaging a respective offset portion.

10. The ski brake defined in claim 1 wherein said engaging means comprises a guide passage in said mounting plate for receiving said offset portion, the axis of said passage being inclined to the longitudinal edge of said ski at an acute angle.

11. The ski brake defined in claim 1 wherein said bent spring wire has a pair of such shanks each provided with a respective one of said offset portions, said offset portions being inclined inwardly toward one another and having free extremities disposed within said mounting plate, each of said shanks being formed with a respective brake element, said brake elements extending substantially the full length of the respective shanks, said mounting plate being formed with a pair of bores including an angle with each other of less than 180° and lying in a common plane parallel to said surface of said ski.

12. The combination with a ski of a ski brake for automatically braking the free flight of the ski upon the release of a ski boot therefrom, comprising:

a mounting plate fixed to an upper surface of the ski;

a bent wire having a pair of shanks disposed at respective longitudinal edges of said ski, a bight between said shanks, said bight and shanks lying in one plane, and respective offset portions lying in another plane within said plate connecting each of said shanks with said plate, said mounting plate being formed with means engaging each of said offset portions and for deforming said wire upon the depression of said bight toward the upper surface of the ski so as to bias said shank toward an upper position upon release of the ski boot from said bight; and respective brake elements mounted on said shanks and adapted to lie substantially along said edges of the ski when said bight is held along said surface but to project downwardly generally transversely to the ski upon release of the bight by said ski boot.

* * * * *

Disclaimer 4,078,825.—*Tilo Riedel,* Eching, Germany. SKI BRAKE WITH ELEMENTS ADAPTED TO FORM A TREAD BODY ENGAGEABLE BY A SKI BOOT AND WITH INWARDLY BENT SPRING WIRE. Patent dated Mar. 14, 1978. Disclaimer filed Mar. 2, 1981, by the assignee, *S. A. Etablissements Francois Salomon & Fils.*

The term of this patent subsequent to June 22, 1993, has been disclaimed. [*Official Gazette April 7, 1981.*]